US005078642A

United States Patent [19]

Glessner

[11] Patent Number: 5,078,642

[45] Date of Patent: Jan. 7, 1992

[54] TOY BAR SOAP SLIDE

[76] Inventor: Jon L. Glessner, 119-B Santa Barbara Dr., Columbus, Ohio 43213

[21] Appl. No.: 602,812

[22] Filed: Oct. 24, 1990

[51] Int. Cl.[5] ..... A63H 23/00; A61H 33/02

[52] U.S. Cl. ..... 446/153; 446/168; 446/177; 4/546; 4/559

[58] Field of Search ..... 446/153, 168, 170, 173, 446/176, 444, 92, 177; 272/56.5 R, 1 B; 4/538, 591, 546, 628, 559; 248/683, 309.3, 309.2, 309.1, 362, 363, 317, 318

[56] References Cited

U.S. PATENT DOCUMENTS

| | | | |
|---|---|---|---|
| D. 291,220 | 8/1987 | Mariol | D21/143 |
| 1,252,616 | 1/1918 | Reif | 446/168 X |
| 1,896,607 | 2/1933 | Brunner | 446/177 X |
| 2,917,864 | 12/1959 | Payne | 46/43 |
| 3,271,896 | 9/1966 | Hines | 46/87 |
| 3,407,939 | 10/1968 | Villar-Kelly | 248/206.3 |
| 3,444,564 | 5/1969 | Lavacchia | 4/559 |
| 3,542,366 | 11/1970 | Schocker | 446/444 X |
| 3,750,991 | 8/1973 | Ragir | 248/205.8 |
| 3,801,094 | 4/1974 | Treaster | 446/168 X |
| 4,242,829 | 1/1981 | Arnstrom et al. | 446/121 |
| 4,313,537 | 2/1982 | Collet | 248/309.1 |
| 4,620,332 | 11/1986 | Laird | 4/559 |
| 4,630,794 | 12/1986 | Ross | 248/309.1 |
| 4,689,032 | 8/1987 | Trossman | 446/153 |
| 4,963,116 | 10/1990 | Huber | 446/153 X |

*Primary Examiner*—Danton D. DeMille

[57] ABSTRACT

A bar soap slide is presented along with a method of construction and use whereby a conventional bathtub can be converted into an arena of entertainment for a child. The bar soap slide is releasably affixed to the inner bathtub walls on a grade which will allow a bar of soap when placed at the upper end, to rapidly descend providing amusement for a child. After use the slide can be quickly removed from the bathtub, rinsed and stored for future use.

7 Claims, 2 Drawing Sheets

TOY BAR SOAP SLIDE

BACKGROUND OF THE INVENTION

1. Field of the Invention

The present invention pertains to a child's play toy and particularly to a soap bar slide and method whereby the slide is attached to the inside walls of a conventional bathtub for amusement purposes.

2. Description of the Prior Art and Objectives of the Invention

It is is well known by parents and the like that young children can be more easily bathed or enticed to enter bathtub water if amusements are provided such as toy boats, floatable balls or certain other toys. Many small children oftentimes cry and vigorously object at the sight of soap or bath water, and by diverting their attention by the use of toys or games such objections frequently can be overcome. It has heretofore been known the children can amuse themselves while in playpens and the like by the use of small attached channels or tracks for rolling balls theredown such as seen in U.S. Pat. No. 2,917,864. However, until the present invention was conceived no one visualized the advantages of having a bar soap toy in a bathtub to allow a child to play with the soap during bathing, thereby creating an environment of fun while making a parent's child bathing task more enjoyable. Therefore, the present invention was developed and one of its objectives is to provide entertainment and diversion to a child while bathing.

It is yet another objective of the present invention to provide a process for constructing a lightweight bar soap slide toy on the inside walls of a bathtub.

It is still yet another objective of the present invention to provide a durable, releasable bar soap slide in combination with a bathtub by utilizing suction cups to maintain the slide in a proper posture.

It is still another objective of the present invention to provide a process for playing with a soap bar slide comprising attaching the slide in sections to the inside walls of the bathtub and thereafter placing a bar of soap thereon which will slide down the descendingly positioned slide member for entertainment purposes.

Various other objectives and advantages of the present invention become apparent to those skilled in the art as a more detailed description is presented below.

SUMMARY OF THE INVENTION

The aforesaid and other objectives are realized by providing a toy slide which will accommodate a conventional soap bar, along the inside walls of a bathtub. The slide may comprise a series of overlappingly engaging sections which are affixed, one to the other in descending or cascading fashion. Thus, by placing a bar of soap in the upper or high end of the slide, the soap bar will race therealong to the lower end in amusing fashion. The elongated slide which may generally be formed from a series of substantially u-shaped, linear and arcuate plastic sections and may include a "loop" section to provide additional enjoyment for the user. The slide and its components may be formed of suitable plastic, aluminum or other preferably nonferrous materials and be quickly attached in "cascading" fashion or disattached from the inside bathtub walls with relative ease by the use of suction cups.

DESCRIPTION OF THE PREFERRED EMBODIMENT

Figure 1:
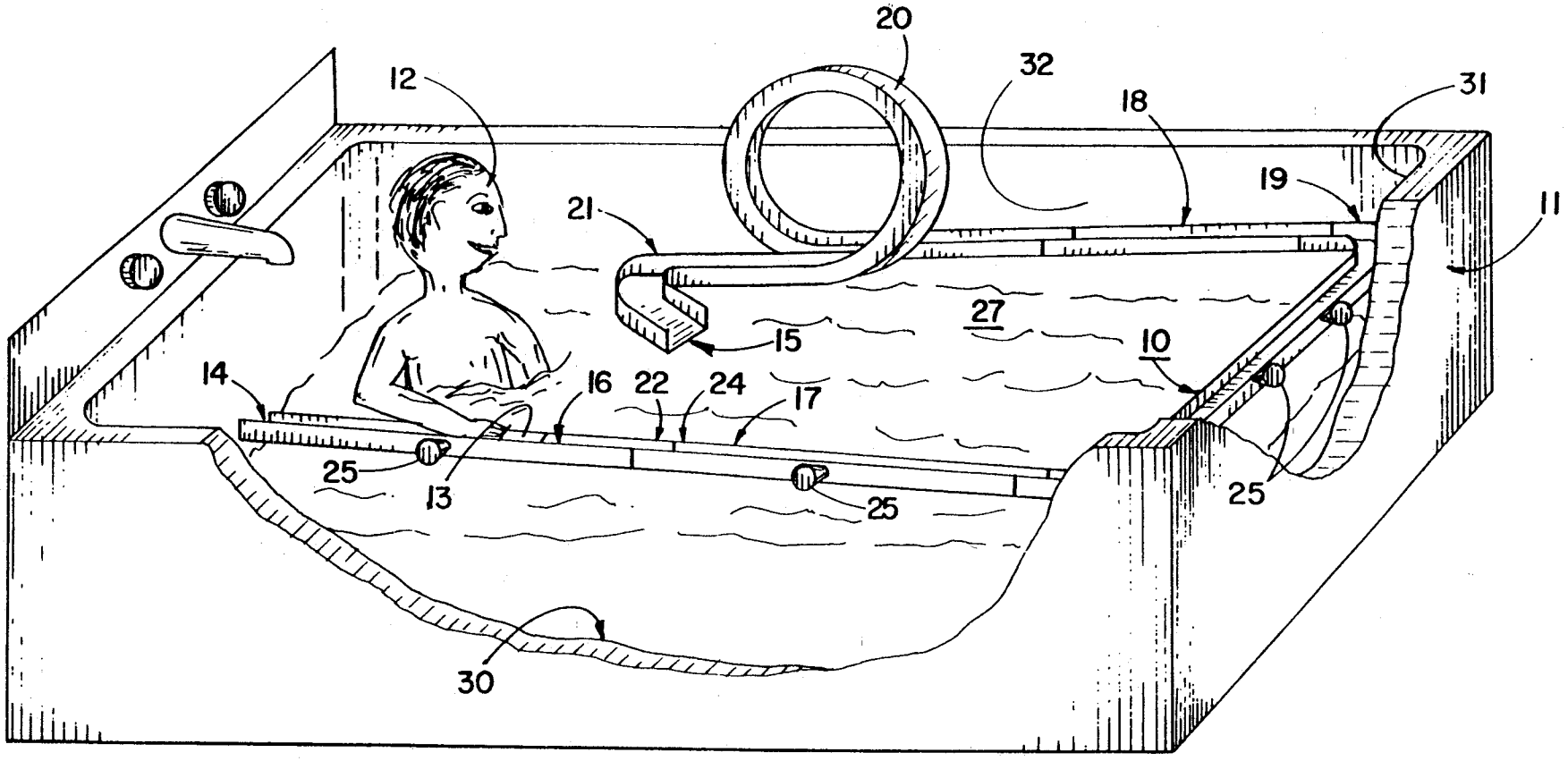
FIG. 1 illustrates a perspective view of a conventional bathtub having a bar soap slide of the invention positioned inside along two sides and one end thereof.

The preferred form of the apparatus of invention is illustrated in FIG. 1 which includes a plurality of straight or linear side slide sections, an arcuate section for attachment to one end of the bathtub, a loop section and a J-shaped end section. All said sections are made of polypropylene and have a u-shaped cross-sectional configuration of approximately three and one-half inches in width and with one-half inch high sides. The sections may each be one-eighth inch thick and are designed to attach to the smooth inside bathtub walls by the use of a plurality of polyvinyl chloride suction cups which are rigidly affixed to the slide sections by conventional fasteners. The suction cups allow for easy, releasably attaching the slide sections to damp bathtub walls. The slide is affixed in a descending fashion along the inside bathtub walls above the normal water level of the bath water to facilitate a soap bar sliding rapidly therealong, although the angle of descent can be varied depending on the particular desire or age of the user. Also one section includes a loop for additional viewing enjoyment as the soap bar "races" down the slide and around the loop.

DETAILED DESCRIPTION OF THE DRAWINGS AND OPERATION OF THE INVENTION

For a more complete understanding of the invention and its method of operation, bar soap slide 10 as shown in FIG. 1 is affixed to the inside walls of conventional bathtub 11. As further shown in FIG. 1, child 12 is placing a soap bar or cake 13 in the upper or front end 14 of slide 10. As would be understood, upper end 14 is vertically above and higher than slide terminal or lower end 15 and both ends are substantially above the level of water 27. Slide 10 as shown in FIG. 1 comprises a series of connectable sections 16, 17, 18, 19, 20 and 21. Sections 16, 17 and 18 are linear, whereas section 19 is arcuate in shape and is affixed to the right end of bathtub 11 as shown in FIG. 1. Section 20 comprises a loop whereas section 21 provides a J-shaped end portion. All slide sections may be extruded from polypropylene or other suitable polymeric materials which are durable, light in weight and are not adversely affected by water. Each section should have a relatively slick inside surface to allow the soap bar to rapidly slide therealong and to help in maintaining the slide in a clean, mildew free condition. The slide sections may have a relatively large front end and a relatively small rear end for engaging by overlapping.

Figure 2:
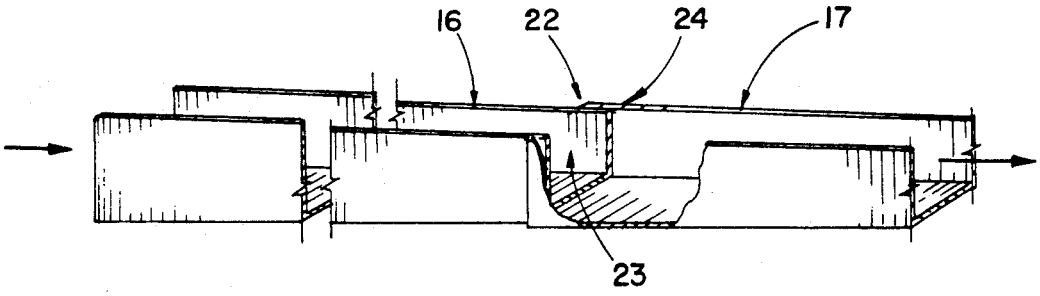
FIG. 2 demonstrates an overlapping joint configuration of two sections of the slide.

As shown in FIG. 2, typical joint 22 is formed by overlapping linear section 17 on the outside of linear section 16 as the inside dimensions of front end 24 of section 17 are larger than the outer dimensions of rear tapered end 23 of section 16, whereby end 23 of section 16 will snugly fit into end 24 of section 17. By overlapping said slide sections which are u-shaped or trough-like in "descending" order as shown in FIG. 2, the soap bar can easily slide therealong without being impeded in its forward progress at the joints. Other methods of forming joints may also be employed.

Figure 3:
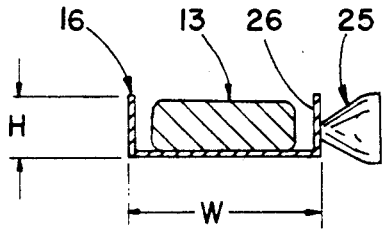
FIG. 3 shows a cross-sectional end view of one of the sections with a soap bar therein.
Figure 6:
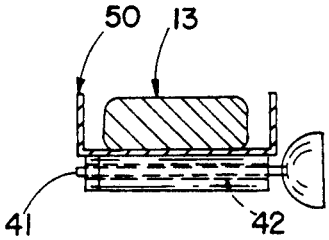
FIG. 6 pictures the device as seen in FIG. 5 along lines 6—6.

FIG. 3 demonstrates a typical cross section of linear section 16 and illustrates soap bar 13 therein. As shown, the width "W" of section 16 is greater than the height "H" to readily accommodate and provide clearance for a typical, unused bar of soap on its side, which bar may have a height of approximately one-half inch and a width of three inches when positioned as in FIG. 3. Suction cup 25 may be bonded to side wall 26 of section 16 as shown in FIG. 3 by conventional fastening means such as a threaded screw, adhesive or otherwise or may be adjustable, rod mounted to allow for varying inside tub widths. Cup 25 comprises a soft, flexible, polyvinyl chloride material although said cup may be formed from synthetic rubber or other compositions to provide a means for attaching slide 10 to the slick, moist, inside walls 30, 31 and 32 of bathtub 11. Other attaching means for slide 10 could likewise be used under particular circumstances as seen in FIGS. 5 and 6.

Figure 5:
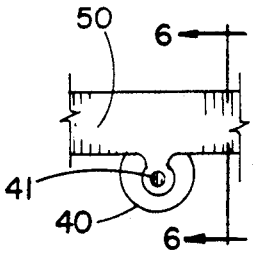
FIG. 5 presents an alternate suction cup attachment to the slide.

In FIG. 5, suction cup 40 is affixed to fragmented slide section 50 by cup rod 41 which slides through rod channel 42 integrally formed as by molding with slide section 50. Channel 42 extends laterally across slide section 50 as seen in FIG. 6. Cup rod 41 may be formed of frangible plastic so the user can vary the space between the tub sides and the slide sections. Rod 41 is made to snugly fit within channel 42 and may originally be approximately five to six inches long before use, and the ultimate length required will depend somewhat on the inside tub widths.

Figure 4:
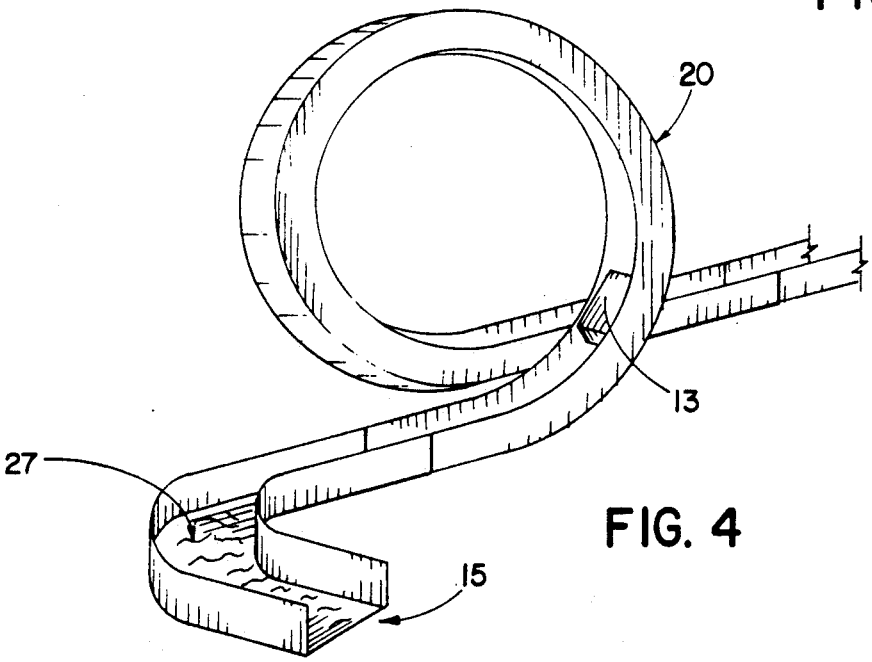
FIG. 4 depicts a slide section having a loop and a J-shaped end section.

For additional fun and viewing entertainment, as seen in FIG. 4, a loop section 20 is provided and bar 13, upon moving at a sufficient velocity, will execute the loop and thereafter rapidly exit terminal end 15. A small amount of water 27 as shown in FIG. 1 can be added to bar soap slide 10 after it is installed in bathtub 11 to help reduce the friction of soap bar 13 if dry. As would be further understood by those skilled in the art, the grade or angle of bar soap slide 10 to the horizon can be varied depending on the age or experience of the child that is playing with it. Older children may prefer a series of loops and turns whereas a smaller (younger) child may desire a substantially linear slide positioned with a relatively low grade for a relatively slow descent of soap bar 13. Also, toy cars of various designs may be carved from soap bars and raced along slide 10. Slide 10 can also be integrally formed within the sides of a bathtub at the time of manufacture, such as when a fiberglass or other bathtub is produced.

The illustrations and examples provided herein are for explanatory purposes and are not intended to limit the scope of the appended claims.

I claim:

1. A toy in combination with a bar of soap and a bathtub, said bathtub having inside walls and a bottom, said toy comprising: an elongated bar soap slide, said slide comprising a substantially u-shaped cross section, said slide attached to the inside bathtub walls at an angle to the horizon to facilitate sliding, a bar of soap for positioning within said slide, whereby said bar of soap can be placed on the slide and viewed as it travels along inside said bathtub.

2. A combination as claimed in claim 1 wherein said slide comprises means to releasably attach said slide to said inside bathtub walls.

3. A combination as claimed in claim 2 wherein said attaching means comprises a suction cup.

4. A combination as claimed in claim 1 wherein said elongated slide is formed from a polymeric material.

5. A combination as claimed in claim 1 wherein said elongated slide comprises a substantially J-shaped section.

6. The combination of claim 1 wherein said slide is substantially u-shaped.

7. The combination of claim 1 wherein said slide comprises a series of connected sections.

* * * * *